United States Patent [19]

Kaplan

[11] Patent Number: 4,823,746

[45] Date of Patent: Apr. 25, 1989

[54] ENGINE IGNITOR WITH INTEGRAL COMPRESSION RELEASE VALVE

[76] Inventor: Selwyn Kaplan, 101 Hermosa Dr., Shell Beach, Calif. 93449

[21] Appl. No.: 600,911

[22] Filed: Sep. 25, 1987

[51] Int. Cl.[4] ..... F02P 19/02; F02N 17/08

[52] U.S. Cl. ..... 123/145 A; 123/169 V

[58] Field of Search ..... 123/143 B, 145 R, 145 A, 123/169 V, 182; 313/120

[56] References Cited

U.S. PATENT DOCUMENTS

| | | | |
|---|---|---|---|
| 960,752 | 6/1910 | White | 123/182 |
| 2,795,220 | 6/1957 | Atwood et al. | 123/145 R |
| 3,079,453 | 2/1963 | Clark | 123/169 V |
| 4,124,012 | 11/1978 | Fuller, Jr. | 123/182 |
| 4,214,567 | 7/1980 | Goto | 123/182 |
| 4,469,059 | 9/1984 | Hukill | 123/169 V |
| 4,699,096 | 10/1987 | Phillips | 123/169 V |

*Primary Examiner*—Willis R. Wolfe

[57] ABSTRACT

The present invention provides an improved engine ignitor with integral pressure release vent to minimize flooding and/or hydraulic locking of internal combustion engines, particularly, single cylinder engines such as model airplane engines, lawn mower engines, and the like. In one embodied form, the unique engine ignitor comprises a glow plug including a threaded shell capable of being screwed into an engine cylinder block, a generally cylindrical heating head, a peripheral grip member disposed between the heating head and glow plug shell, and an integral vent element disposed on a peripheral portion of the threaded shell. In operation, once a user has discovered that an engine is flooded or hydraulically locked, the inventive glow plug is rotated within the combustion cylinder to allow the flooded chamber to vent. After the chamber has been vented, the operator will again rotate the glow plug in its original located position within the combustion cylinder.

3 Claims, 1 Drawing Sheet

ENGINE IGNITOR WITH INTEGRAL COMPRESSION RELEASE VALVE

BACKGROUND OF THE INVENTION

This invention relates to engine ignitors, and more particularly, to an improved glow plug which minimizes flooding and/or hydraulic locking of single cylinder engines.

Numerous small sized internal combustion engines, comprise glow plugs which are designed to heat fuel introduced into internal combustion cylinders of an engine. Typically, the fuel may be atomized by an injection nozzle, mixed with air in a suction conduit and ignited by means of a glow plug.

Various skilled artisans have sought to improve conventional glow plugs by various means.

Matayoshi, et al., in U.S. Pat. No. 4,240,392, discloses one such improvement in which a glow plug can be electromagnetically or hydraulically moved relative to a fixed shell. This improvement was designed to provide a glow plug for a compression-ignited internal combustion engine having a swirl-producing free combustion chamber. The Matayoshi glow plug is stated to achieve an effective pre-heating of air in the pre-combustion chamber at cold starting of the engine, but at other times, occupy only a negligible volume thereby offering little obstruction to the production of a swirl of air in the pre-combustion chamber.

Nagai, et al. in U.S. Pat. No. 3,407,794, discloses a glow plug arrangement in which a stream of fuel is guided through an annular gap about the rear portion of a heated glow plug. The Nagai glow plug comprises an outer metal shell and a wire helix located in the shell and embedded in insulating material. An annular gap is provided in the region of the rear end for feeding liquid fuel in the annular gap. Accordingly, fuel fed into the annual gap will flow in an annular stream about the heated shell of the glow plug to be thus heated and completely evaporated without coming in contact with the wire helix so that the air fuel fixture forming in the region of the front end of the glow plug will be ignited by the latter.

U.S. Pat. No. 4,397,273, issued to Folkerts, discloses a retractable engine ignitor such as a glow plug for diesel engines. The inventive ignitor is arranged to be extended into an internal combustion engine when needed to aid starting and ignition. It is retracted from the combustion chamber when starting aid is no longer required in order to reduce interference with gas flow in the combustion chamber and the formation of particulates in the combustion process.

The patent to Sumner (U.S. Pat. No. 1,361,116) relates to a starting ignitor for an internal combustion engine. One of the stated objects of the Sumner invention is to provide an improved device for starting an engine to ensure prompt and certain ignition, until the heat generated by the burning of the fuel has heated up the normal igniting surfaces to a sufficient temperature to ignite the fuel. As shown in the patent drawings, the ignition member includes a plug which may be inserted and removed as necessary. As stated in the disclosure, when the engine is running under normal conditions, the valve (4) is closed and the electrical connection with starting plug is removed. By keeping the igniting member of the ignition plug removed from the free and open exposure to the heat, excessive heating thereof is prevented.

In addition to striving to improve flow characteristics of fuel introduced into internal combustion engines, a number of skilled artisans have recognized a significant need to correct the occurrence of flooding and/or hydraulic locking of single cylinder engines. This problem can occur when too much fuel is introduced into the combustion chamber, for instance, by excessive fuel injection during the ignition process. If the air-to-fuel ratio is too rich with fuel, heating alone of the fuel/air mixture will not necessarily produce combustion.

With conventional engine ignitors, one way of correcting flooding or hydraulically locking of the engine cylinder, is for the operator to simply leave the engine in a flooded condition, wait a sufficient period of time for the fuel mixture to hopefully evaporate from the engine cylinder, and thereafter, to return to re-attempt ignition of the engine by normal procedure.

Those skilled in the art, however, have recognized a significant need for a convenient means to vent flooded or hydraulically locked engine cylinders by a more reliable and convenient mechanism. The present invention fulfills these needs.

SUMMARY OF THE INVENTION

The present invention provides an improved engine ignitor with integral pressure release vent to minimize flooding and/or hydraulic locking of internal combustion engines, particularly those of single cylinder types.

In one embodied form, the unique engine ignitor comprises a glow plug including a threaded shell capable of being screwed into a cylinder engine block, a generally cylindrical heating head, a peripheral grip member disposed between the heating head and the glow plug shell, and an integral vent element disposed on the peripheral portion of the threaded shell.

In a presently preferred embodiment, the vent may be described as a longitudinal slot disposed on a portion of the threaded periphery of the glow plug shell.

In operation, once a user has discovered that an engine is flooded or hydraulically locked, the inventive glow plug is rotated within the combustion chamber to allow the flooded cylinder to vent. After the chamber has been vented, the operator will again rotate the glow plug in its original locked position within the combustion cylinder.

Other features and advantages of the present invention will become readily apparent from the attached description of the preferred embodiments, drawing, and claims.

DESCRIPTION OF THE PREFERRED EMBODIMENTS

The present invention relates to engine ignitors, and more particularly, to an improved glow plug which minimizes flooding and/or hydraulic locking of single cylinder engines.

In more detail, the improved engine ignitor comprises a glow plug including a threaded shell capable of being screwed into an internal combustion engine cylinder block; a generally cylindrical heating head; a peripheral grip member disposed between the heating head and glow plug shell; and an integral vent element disposed on a peripheral portion of the threaded shell.

Figure 1:
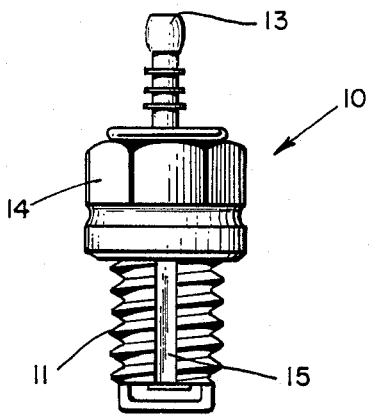
FIG. 1 is a side elevational view of one embodied form of an improved engine ignitor with integral compression release valve in accordance with the present invention.

Referring now to FIG. 1, there is depicted one embodied form of the inventive engine ignitor, generally denoted 10. The unique engine ignitor 10 comprises a threaded shell 11 capable of being screwed into an engine cylinder block 12 (see FIG. 2).

In more detail, the glow plug 10 comprises a generally cylindrical heating head 13, and peripheral grip means 14, to permit grasping of the threaded shell 11 by suitable mechanical tools, such as a wrench (not shown). The peripheral grip member 14 is preferably disposed between the heating head 13 and the glow plug shell 11.

An integral vent element 15 is disposed on a peripheral portion of the threaded shell 11. The vent element 15 may be generally described as a longitudinal slot axially disposed on threaded shell 11 and substantially parallel to the longitudinal axis of the glow plug 10.

Figure 2:
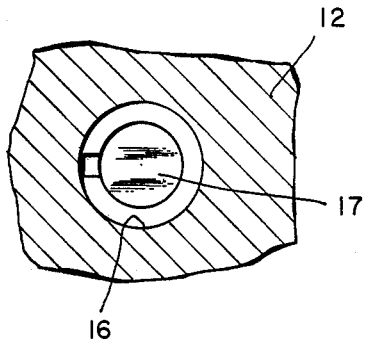
FIG. 2 is a top elevational view depicting a segment of an internal combustion engine cylinder having a circumferential portion comprising a complimentary threaded section for receiving a threaded shell of the engine ignitor.

As shown in FIG. 2, a sectional portion of the engine cylinder block 12 includes a circumferential threaded section 16 which is complimentary with the threaded shell 11 disposed on the inventive engine ignitor 10. A hole 17 is disposed in the engine cylinder block 12 and suitably sized to receive the threaded shell 11 of the engine ignitor 10. That is to say, the internal diameter of the hole 17 closely approximates the outer diameter of the threaded shell 11 of the glow plug 10.

Figure 3:
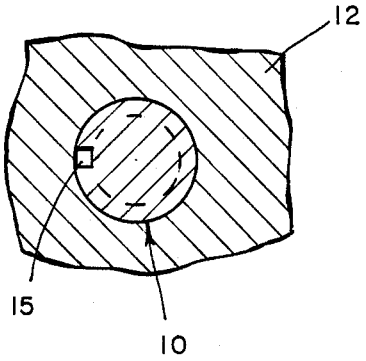
FIG. 3 is a top elevational view of the segment of internal combustion engine cylinder depicted in FIG. 2 and illustrating insertion of the inventive glow plug therein with integral vent in an "open" vented position.

In operation, once a user has discovered that an engine cylinder is flooded, or hydraulically locked, the inventive glow plug 10 is rotated within the combustion cylinder so as to allow trapped excessive fuel in the cylinder to escape through the vent element 15 disposed on a peripheral portion of the threaded shell 11. The open or vented position of the glow plug 10 within the cylinder block 12 is depicted in FIG. 3.

The rotation of the inventive glow plug 10 may be accomplished by manual tools such as a wrench (not shown), grasped about the peripheral grip means 14, or may be by automated means, for instance, a spring loaded activator.

Figure 4:
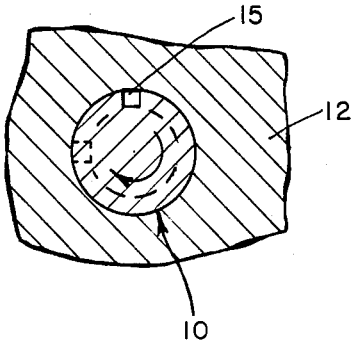
FIG. 4 is a top elevational view of the engine cylinder with glow plug inserted therein and rotated 90 degrees from the position shown in FIG. 3 thereby closing the integral vent of the engine ignitor in accordance with the present invention.

As depicted in FIG. 4, once the chamber of the cylinder block 12 has been vented, the operator will again rotate the glow plug 10 in its original locked position, for instance, by a 90 degree rotation, within the cylinder block 12.

Accordingly, the present invention provides a convenient and efficient means for minimizing flooding and/or hydraulic locking of internal combustion engines, particularly, single cylinder engines such as model airplanes, lawn mowers and the like.

Various modifications may be made by those skilled in the art without departing from the spirit and scope of this invention. Accordingly, it is not intended that the invention be limited except as by the appended claims.

I claim:

1. An improved engine ignitor comprising in combination:

(a) a glow plug including a threaded shell capable of being screwed into an internal combustion cylinder block;

(b) a generally cylindrical heating head;

(c) a peripheral grip member disposed between the heating heat and said threaded shell of said glow plug; and (d) an integral vent element disposed on a peripheral portion of said threaded shell;

wherein said peripheral grip member is capable of manual rotation within said cylinder block to a first position to allow trapped excessive fuel in said cylinder block to escape through said vent element disposed on a peripheral portion of said threaded shell, and to a second position to close said vent element and to lock said glow plug into said cylinder block.

2. The improved engine ignitor is defined in claim 1 wherein said vent element is a longitudinal slot axially disposed on said threaded shell.

3. The improved engine ignitor as defined in claim 2 wherein said vent element is disposed on said threaded shell and oriented along a longitudinal axis substantially parallel to the longitudinal axis of said glow plug.

* * * * *